US008549977B2

(12) United States Patent
Ahn et al.

(10) Patent No.: US 8,549,977 B2
(45) Date of Patent: Oct. 8, 2013

(54) APPARATUS FOR OPENING AND CLOSING BREECH BLOCK AND CANNON HAVING THE SAME

(75) Inventors: Sang-Tae Ahn, Daejeon (KR); Kuk-Jeong Kang, Daejeon (KR); Tae-Ho Han, Daejeon (KR); Cheon-Gon Jeon, Gyeongsangnam-Do (KR)

(73) Assignee: Agency for Defense Development (KR)

( * ) Notice: Subject to any disclaimer, the term of this patent is extended or adjusted under 35 U.S.C. 154(b) by 33 days.

(21) Appl. No.: 13/337,642

(22) Filed: Dec. 27, 2011

(65) Prior Publication Data

US 2013/0160636 A1 Jun. 27, 2013

(51) Int. Cl.
*F41A 3/10* (2006.01)
*F41A 3/00* (2006.01)

(52) U.S. Cl.
USPC ..... 89/17

(58) Field of Classification Search
USPC ..... 89/17, 22, 23, 24, 25
See application file for complete search history.

(56) References Cited

U.S. PATENT DOCUMENTS

| | | | | | |
|---|---|---|---|---|---|
| 1,008,223 | A | * | 11/1911 | Voeller | 89/4.2 |
| 1,032,780 | A | * | 7/1912 | Schneider | 89/24 |
| 1,576,962 | A | * | 3/1926 | Froelich | 89/24 |
| 2,756,635 | A | | 7/1956 | Engel et al. | |
| 4,341,031 | A | * | 7/1982 | Palmer et al. | 42/23 |
| 4,462,299 | A | * | 7/1984 | Grunewald et al. | 89/24 |
| 4,986,162 | A | * | 1/1991 | Wissing | 89/24 |
| 4,991,490 | A | * | 2/1991 | Balbo et al. | 89/24 |
| 5,307,724 | A | * | 5/1994 | Breuer et al. | 89/24 |
| 5,589,656 | A | * | 12/1996 | Tortorici, Jr. | 89/24 |
| 2004/0226435 | A1 | * | 11/2004 | Isgen et al. | 89/24 |
| 2012/0132062 | A1 | * | 5/2012 | Herrmann et al. | 89/17 |

FOREIGN PATENT DOCUMENTS

| | | |
|---|---|---|
| GB | 2 334 083 | 8/1999 |
| WO | WO 89/08232 | 9/1989 |

OTHER PUBLICATIONS

Search Report issued by European Patent Office on Jun. 1, 2012 in connection with corresponding European patent application No. EP 11 19 5782.

* cited by examiner

*Primary Examiner* — Bret Hayes
(74) *Attorney, Agent, or Firm* — Ostrolenk Faber LLP

(57) ABSTRACT

An apparatus for opening and closing a breech block includes a cam follower, a housing, a first plunger, a rotation unit, a pressurizing unit, an open cam, a first elastic member, and a second plunger. In the present invention, in a state that the open cam is out of the range of a moving path of the cam follower so as to restrict rotation of the cam follower, the second plunger is inserted into the housing so as to support the pressurizing unit. This may allow a closed state of the breech block to be maintained after firing. Furthermore, in the present invention, a closed mode of the breech block may be converted into an open mode, through simple manipulations, e.g., by rotating the rotation unit, i.e., by moving the pressurizing unit.

14 Claims, 6 Drawing Sheets

APPARATUS FOR OPENING AND CLOSING BREECH BLOCK AND CANNON HAVING THE SAME

BACKGROUND OF THE INVENTION

1. Field of the Invention

The present invention relates to an apparatus for opening and closing a breech block and a cannon having the same.

2. Background of the Invention

A cannon indicates a large weapon for firing ammunition by using a force of gas generated when an explosive is exploded from a pipe having one blocked side. A cannon barrel unit of the cannon consists of a cannon barrel and a breech device. The breech device consists of a breech block and a breech ring for accommodating the breech block therein.

The breech block serves to prevent combustion gas of an explosive from discharging to a rear side of a cartridge chamber, by blocking the rear side of the cartridge chamber when ammunition is fired from the cannon. The breech block is configured to open and close a rear side of a cartridge chamber of a cannon barrel for loading of ammunition.

In order to prevent introduction of harmful gas from the cannon barrel at the time of chemical, biological and radiological (CBR) warfare, a closed state of the breech block has to be maintained after firing.

Accordingly, may be considered an apparatus for opening and closing a breech block capable of automatically converting a mode of the breech block to an open mode from a closed mode through simple manipulations, and a cannon having the same.

SUMMARY OF THE INVENTION

Therefore, an aspect of the detailed description is to provide an apparatus for opening and closing a breech block capable of maintaining a closed state of the breech block after firing.

Another aspect of the detailed description is to provide an apparatus for opening and closing a breech block capable of being operated through simple manipulations, and a cannon having the same.

To achieve these and other advantages and in accordance with the purpose of this specification, as embodied and broadly described herein, there is provided an apparatus for opening and closing a breech block, the apparatus comprising: a cam follower connected to a breech block for opening and closing a cartridge chamber of a cannon barrel, and rotating so as to open and close the breech block; a housing mounted to a bracket; a first plunger mounted in the housing, and disposed to be moveable to one direction; a rotation unit rotatably mounted to the bracket; a pressurizing or intermediate unit coupled to the rotation unit, inserted into the housing, and configured to pressurize the first plunger when the rotation unit rotates; an open cam coupled to the rotation unit, and moveable by rotation of the rotation unit between a first state for guiding rotation of the cam follower and a second state which is out of the range of a moving path of the cam follower; a first elastic member installed in the housing, and configured to support the first plunger such that a restoration force is applied to the rotation unit; and a second plunger moveably mounted to the housing, and configured to support the intermediate unit in the second state by movements.

The apparatus for opening and closing a breech block may further comprise a second elastic member mounted to the housing, and configured to apply an elastic force to the second plunger.

A moving direction of the first plunger may be perpendicular to a rotation shaft of the rotation unit, and a moving direction of the second plunger may be perpendicular to the moving direction of the first plunger.

One surface of the first plunger pressurized by the intermediate unit may have a hemispherical shape.

The apparatus for opening and closing a breech block may further comprise a plurality of guide portions formed in the housing, and protruding toward the center of an inner space of the housing so as to guide movements of the first plunger.

A stopping recess may be formed at the pressurizing unit, and a stopping protrusion inserted into the stopping recess may be formed at one end of the second plunger.

A protrusion may be formed at the second plunger, and the stopping protrusion may be inserted into the stopping recess when the protrusion comes in contact with the housing.

To achieve these and other advantages and in accordance with the purpose of this specification, as embodied and broadly described herein, there is also provided a cannon, comprising: a cannon barrel configured to fire ammunition; a breech block configured to open and close a cartridge chamber of the cannon barrel for loading of ammunition; a cannon holder configured to mount the cannon barrel thereat, and inclined with respect to a ground surface such that the cannon barrel is toward a specific firing direction; and an apparatus for opening and closing a breech block having an open cam configured to be moveable by rotation of a rotation unit between a first state for guiding rotation of a cam follower and a second state which is out of the range of a moving path of the cam follower.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, an apparatus for opening and closing a breech block and a cannon having the same will be explained in more details with reference to the attached drawing. A singular expression of this specification includes a plural concept unless there is a contextually distinctive difference therebetween.

Figure 1:
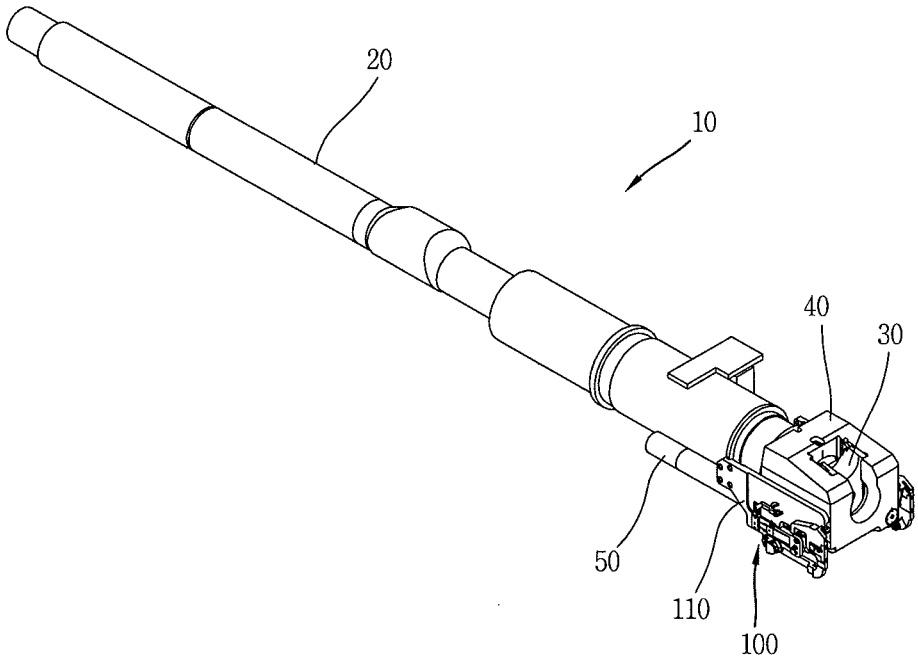
FIG. 1 is a perspective view illustrating a cannon according to a first embodiment of the present invention.

FIG. 1 is a perspective view illustrating a cannon 10 according to a first embodiment of the present invention.

Referring to FIG. 1, the cannon 10 comprises a cannon barrel 20, a breech device, a cannon holder 50, and an apparatus 100 for opening and closing a breech block. The cannon 10 may be implemented as a tank gun or a machine gun.

The cannon barrel 20 is formed in a shape extending to one direction such that ammunition is fired along a specific direction. The cannon barrel 20 is provided with rifle therein.

The breech device consists of a breech block 30 and a breech ring 40 for accommodating the breech block 30 therein. The breech block 30 is configured to open and close a rear side of a cartridge chamber of the cannon barrel 20 for loading of ammunition. The breech ring 40 is configured to accommodate therein a rear end of the cannon barrel 20 and the breech block 30, and to backward and forward move in a restricted state with respect to the cannon barrel 20.

The cannon barrel 20 for firing ammunition is mounted to the cannon holder 50. The cannon holder 50 may be inclined with respect to the ground such that the mounted cannon barrel 20 is toward a preset firing direction.

The apparatus 100 for opening and closing a breech block is disposed near the breech block 30, and is configured to open and close the breech block 30 through a mechanism of a cam follower 33 (refer to FIG. 2A) which rotates so as to open and close the breech block 30, and an open cam 170 (refer to FIG. 2A) for guiding rotation of the cam follower 33.

Figure 2A:
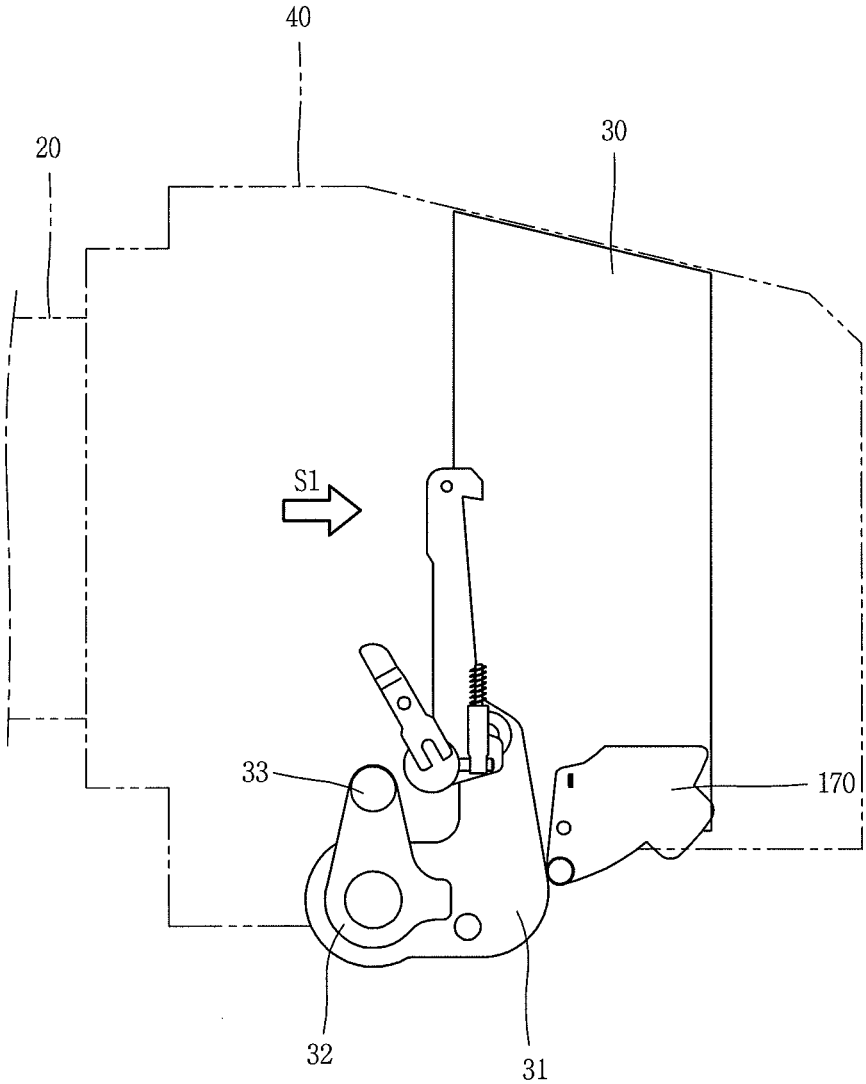
FIGS. 2A and 2B are views illustrating a state that a breech block is open as a cam follower and an open cam come in contact with each other.
Figure 2B:
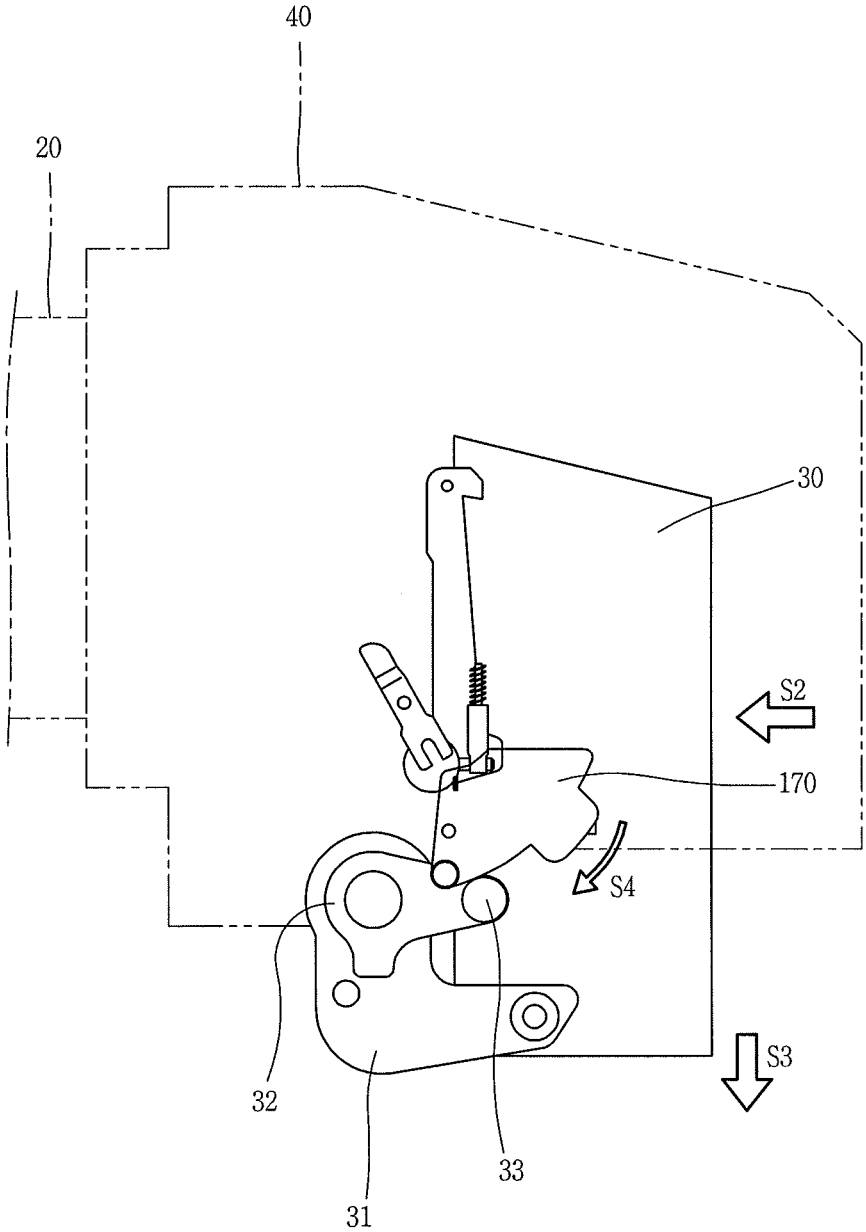

FIGS. 2A and 2B are views illustrating a state that the breech block 30 is open as the cam follower 33 and the open cam 170 come in contact with each other. More concretely, FIG. 2A illustrates a state that the cam follower 33 moves toward the open cam 170 as the cannon barrel 20 backward moves (the direction of 'S1') after firing. And, FIG. 2B illustrates a state that the breech block 30 is open (the direction of 'S3') as the cam follower 33 slides with contacting the open cam 170 (the direction of 'S4') when the cannon barrel 20 forward moves (the direction of 'S2').

Referring to FIGS. 2A and 2B, a breech crank 31 is connected to the breech block 30. As the breech crank 31 rotates, the breech block 30 is open and closed. An open crank 32 is connected to the breech crank 31, and the cam follower 33 is formed at the open crank 32. The cam follower 33 rotates with contacting the open cam 170 when the cannon barrel 20 forward moves. A rotation unit 150 (refer to FIG. 3) is mounted to a bracket 110 (refer to FIG. 3) spacing from a breech ring 40, and the open cam 170 is coupled to the rotation unit 150.

While the cannon barrel 20 backward moves after firing, the breech block 30 connected to the cannon barrel 20 moves to an opposite direction to a firing direction. The cam follower 33 connected to the breech block 30 moves to the opposite direction, and slides along one surface of the open cam 170.

As the cannon barrel 20 forward moves after the backward moving, the cam follower 33 moves to a firing direction together with the breech block 30. While moving to the firing direction, the cam follower 33 comes in contact with the open cam 170.

The cam follower 33 slides along one surface of the open cam 170, and the breech crank 31 rotates together with the cam follower 33 which is rotating. As the breech crank 31 rotates, the breech block 30 moves to one direction to be open, and the cartridge chamber of the cannon barrel 20 is open. An empty cartridge is discharged to the outside through the open breech block 30.

Then, once the cam follower 33 has passed a sliding section of the open cam 170 to be separated from the open cam 170, the cam follower 33 returns to the original position prior to the contact with the open cam 170. As the breech crank 31 rotates, the breech block 30 moves to one direction to be closed, and the cartridge chamber of the cannon barrel 20 is closed.

As aforementioned, the breech block 30 is open and closed by interworking between the cam follower 33 and the open cam 170. Hereinafter, will be explained a structure of the apparatus 100 for opening and closing a breech block, and a mechanism for opening and closing the breech block 30 by the apparatus 100.

Figure 3:
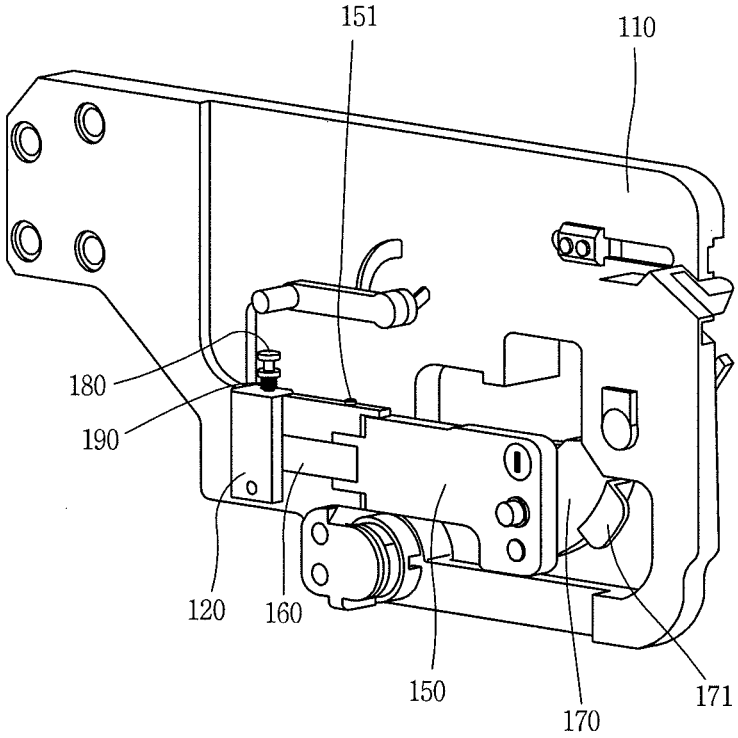
FIG. 3 is a perspective view illustrating an apparatus for opening and closing a breech block according to a first embodiment of the present invention.
Figure 4:
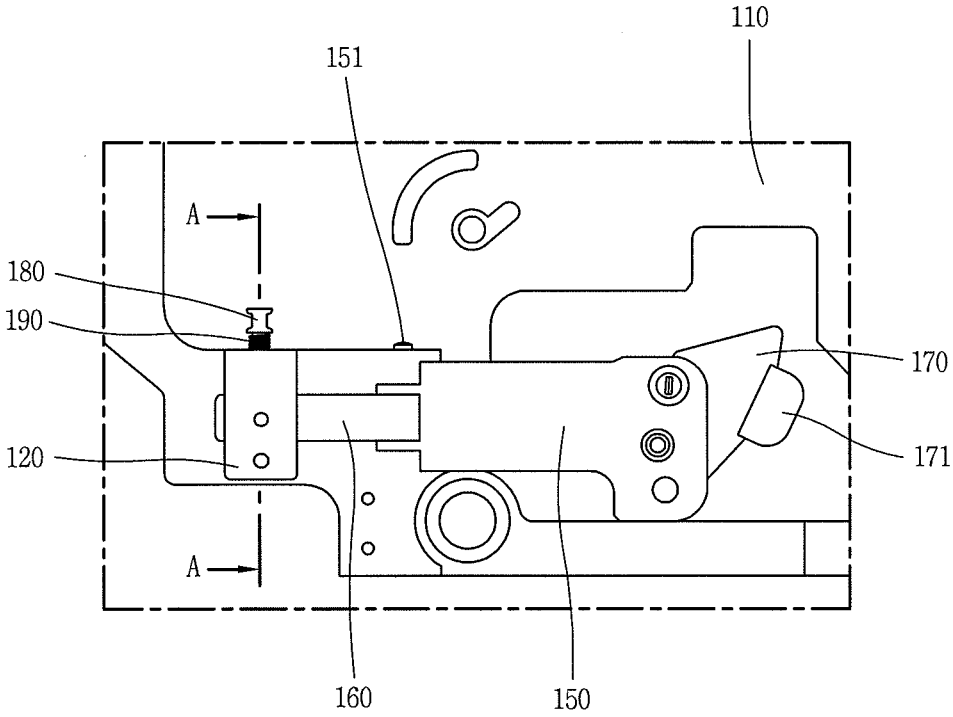
FIG. 4 is a front view of the apparatus for opening and closing a breech block of FIG. 3.

FIG. 3 is a perspective view illustrating the apparatus 100 for opening and closing a breech block according to a first embodiment of the present invention, and FIG. 4 is a front view of the apparatus 100 for opening and closing a breech block of FIG. 3.

Referring to FIGS. 3 and 4, the apparatus 100 for opening and closing a breech block comprises a cam follower 33, a housing 120, a first plunger 130, a second plunger 180, a rotation unit 150, a intermediate unit 160, an open cam 170 and a first elastic member 140.

As aforementioned, the cam follower 33 is connected to the breech block 30 through the breech crank 31, and rotates so as to open and close the breech block 30.

The bracket 110 is disposed to be spacing from the breech ring 40. One end of the bracket 110 may be fixed to the cannon holder 50. While the cannon barrel 20 backward and forward moves according to a firing state, the cam follower 33 and the bracket 110 may perform a relative motion with respect to each other.

The housing 120 and the rotation unit 150 are coupled to the bracket 110. The housing 120 may be integrally formed with the bracket 110.

The first plunger 130 (refer to FIG. 5) is installed in the housing 120 so as to be moveable in one direction. A moving direction of the first plunger 130 may be perpendicular to the bracket 110, for instance.

The rotation unit 150 is rotatably mounted to the bracket 110 so as to be rotatable centering around a rotation shaft 151. The rotation shaft 151 of the rotation unit 150 may be disposed in parallel with the bracket 110. The rotation unit 150 may rotate such that one end thereof approaches to or is spacing from the breech block 30. The rotation unit 150 may be inserted into a space formed as part of the bracket 110 is cut. The intermediate unit 160 is coupled to one end of the rotation unit 150, and the open cam 170 may be mounted to another end of the rotation unit 150.

The intermediate unit 160 is inserted into the housing 120, and is configured to pressurize the first plunger 130 when the rotation unit 150 rotates. The rotation shaft 151 of the rotation unit 150 is perpendicular to a moving direction of the first plunger 130 such that a pressurizing direction of the intermediate unit 160 is parallel to the moving direction of the first plunger 130.

The open cam 170 may be configured such that the cam follower 33 slides along one surface of the open cam 170 when the cannon barrel 20 backward moves, and such that the cam follower 33 rotates with sliding along one surface of the open cam 170 with contacting the open cam 170 when the cannon barrel 20 forward moves.

The open cam 170 is configured to be moveable between a first state (open mode of the breech block 30) for guiding rotation of the cam follower 33 by rotation of the rotation unit 150, and a second state (closed mode of the breech block 30) which is out of the range of a moving path of the cam follower 33.

The first elastic member 140 (refer to FIG. 5) is installed in the housing 120, and pressurizes the first plunger 130 such that a restoration force is applied to the intermediate unit 160. One end of the first elastic member 140 is supported by the housing 120, and another end thereof is supported by the first plunger 130. The first elastic member 140 may be formed of a spring, an elastic rubber, a sponge, etc.

The second plunger 180 may be moveably mounted to the housing 120, and may be inserted into a space formed by movements of the intermediate unit 160 such that the intermediate unit 160 is supported in the second state. The second plunger 180 may be disposed such that a moving direction thereof is perpendicular to a moving direction of the first plunger 130.

A second elastic member 190 for providing an elastic force to the second plunger 180 may be mounted to the housing 120. One end of the second elastic member 190 is supported by the housing 120, and another end thereof is supported by the second plunger 180. The second elastic member 190 may be formed of a spring, an elastic rubber, a sponge, etc.

Figure 5:
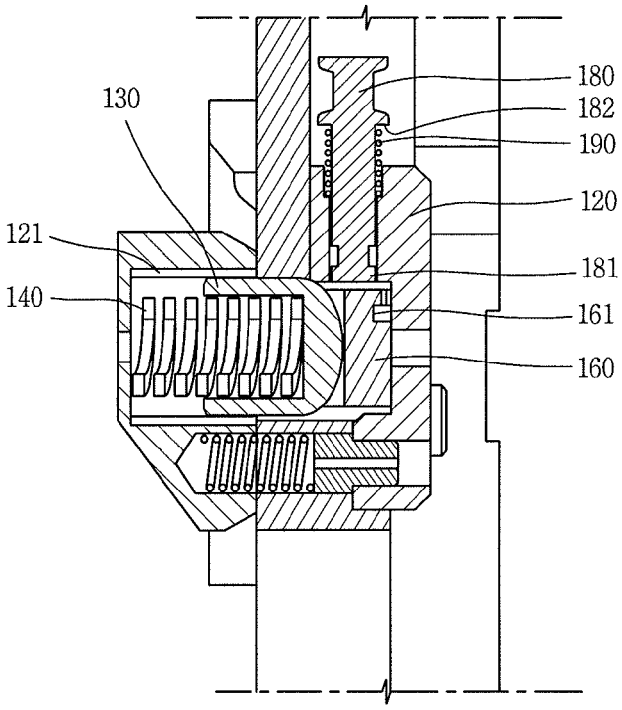
FIG. 5 is a sectional view of an apparatus for opening and closing a breech block taken along line 'A-A' when a breech block is in an open mode.
Figure 6:
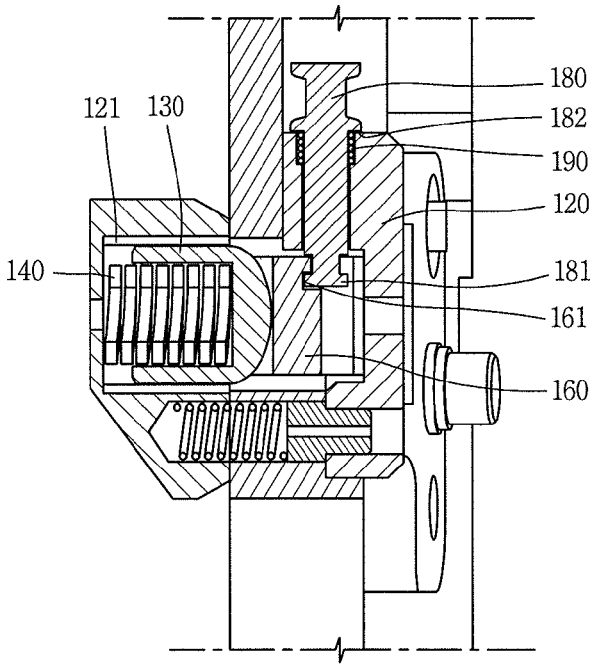
FIG. 6 is a sectional view of an apparatus for opening and closing a breech block taken along line 'A-A' when a breech block is in a closed mode.

FIG. 5 is a sectional view of the apparatus 100 for opening and closing a breech block taken along line 'A-A' when the breech block 30 is in an open mode, and FIG. 6 is a sectional view of the apparatus 100 for opening and closing a breech block taken along line 'A-A' when the breech block 30 is in a closed mode.

Referring to FIGS. 5 and 6, a plurality of guide portions 121 may be formed in the housing 120 so as to be protruding toward the center of an inner space of the housing 120. The guide portions 121 serve to guide movements of the first plunger 130, and to minimize frictions occurring when the first plunger 130 moves.

One surface of the first plunger 130 pressurized by the intermediate unit 160 may have a hemispherical shape. If one surface of the first plunger 130 has a hemispherical shape, the intermediate unit 160 comes in point-contact with the first plunger 130. This may minimize frictions between the first plunger 130 and the intermediate unit 160.

A stopping recess 161 may be formed at the intermediate unit 160, and a stopping protrusion 181 inserted into the stopping recess 161 may be formed at one end of the second plunger 180. As the stopping protrusion 181 is inserted into the stopping recess 161, the second plunger 180 may fix the intermediate unit 160 more stably.

A protrusion 182 may be formed at the second plunger 180. When the protrusion 182 moves to one direction thus to come in contact with the housing 120, the stopping protrusion 181 may be inserted into the stopping recess 161. Accordingly, a user may press the second plunger 180 until the second plunger 180 comes in contact with the housing 120 such that the stopping protrusion 181 is precisely inserted into the stopping recess 161. One end of the second elastic member 190 may be supported by the protrusion 182, and another end thereof may be supported by the housing 120 or a recess of the housing 120.

Referring to FIG. 5, the intermediate unit 160 is pressurized by the first elastic member 140 for providing an elastic force to the first plunger 130, thereby contacting one surface of the housing 120. When the cannon barrel 20 forward moves, the open cam 170 connected to the intermediate unit 160 through the rotation unit 150 is disposed at a position for guiding movements of the cam follower 33.

When the cannon barrel 20 backward moves after firing, the cam follower 33 slides along one surface of the open cam 170. During this sliding, the cam follower 33 pushes the open cam 170 to a direction spacing from the breech block 30. As a result, the rotation unit 150 rotates, and the intermediate unit 160 moves to a direction approaching to the breech block 30 thus to pressurize the first plunger 130.

Once the cam follower 33 has passed the open cam 170, the intermediate unit 160 is pressurized by the first elastic member 140 thus to return to a position for guiding movements of the cam follower 33.

While the cannon barrel 20 forward moves, the cam follower 33 rotates with sliding-contacting the open cam 170. As a result, the breech crank rotates together with the cam follower 33, and the breech block 30 connected to the breech crank is open.

As aforementioned, when the breech block 30 is in an open mode, the open cam 170 is disposed at a position for guiding movements of the cam follower 33. Accordingly, the breech block 30 is open or closed as the cannon barrel 20 backward and forward moves according to a firing state.

Referring to FIG. 6, the pressurizing unit 160 pressurizes the first plunger 130, and the second plunger 180 is inserted into a space formed by movements of the intermediate unit 160 so as to support the intermediate unit 160.

Since the intermediate unit 160 is fixed after moving by the second plunger 180, the rotation unit 150 rotates centering around the rotation shaft 151. The open cam 170 connected to the rotation unit 150 maintains a second state which is out of the range of a moving path of the cam follower 33.

Even if the cannon barrel 20 backward and forward moves in the second state, the open cam 170 does not come in contact with the cam follower 33. Accordingly, the breech block 30 is not open after firing, but maintains a closed state.

In order to maintain a second state (closed mode of the breech block 30) after firing, a user may move the open cam 170 to a direction spacing from the breeching mechanism 30 with using a handgrip 171 of the open cam 170. Then, the user may insert the second plunger 180 into a space formed by movements of the intermediate unit 160. This mode conversion of the breech block 30 into a closed mode may be used to prevent harmful gas from the cannon barrel 20 from being introduced to a user at the time of chemical, biological and radiological (CBR) warfare.

Once the open cam 170 has moved to a direction spacing from the breech block 30 in the second state, the current state of the breech block 30 may be converted into the first state. More concretely, once the open cam 170 has moved to be spacing from the cam follower 33, the intermediate unit 160 connected to the open cam 170 through the rotation unit 150 more pressurizes the first plunge. Once the second plunge has been separated from the intermediate unit 160, it returns to the initial position by the second elastic member 190 thus to be out of the range of a moving path of the intermediate unit 160. As a result, the intermediate unit 160 is pressurized by the first elastic member 140 thus to be restored to the initial position.

That is, a mode of the apparatus 100 for opening and closing a breech block is converted into an open mode of the breech block 30.

Under this configuration, a user may convert a current mode of the breech block 30 to an open mode from a closed mode, through simple manipulations, i.e., by moving the open cam 170.

In the present invention, in a state that the open cam is out of the range of a moving path of the cam follower so as to restrict rotation of the cam follower, the second plunger is inserted into the housing so as to support the intermediate unit. This may allow a closed state of the breech block to be maintained after firing.

In the present invention, a closed mode of the breech block may be converted into an open mode, through simple manipulations, e.g., by rotating the rotation unit, i.e., by moving the pressurizing unit.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An apparatus for opening and closing a breech block, the apparatus comprising:

a cam follower connected to a breech block for opening and closing a cartridge chamber of a cannon barrel, and rotating so as to open and close the breech block;

a housing mounted to a bracket;

a first plunger mounted in the housing, and disposed to be moveable in one direction;

a rotation unit rotatably mounted to the bracket;

an intermediate unit coupled to the rotation unit, inserted into the housing, and configured to press the first plunger when the rotation unit rotates;

an open cam coupled to the rotation unit, and moveable by rotation of the rotation unit between a first state for guiding rotation of the cam follower and a second state which is out of the range of a moving path of the cam follower;

a first elastic member installed in the housing, and configured to support the first plunger such that a restoration force is applied to the rotation unit; and a second plunger moveably mounted in the housing, and configured to support the intermediate unit in the second state by movement of the second plunger.

2. The apparatus of claim 1, further comprising a second elastic member mounted to the housing, and configured to apply an elastic force to the second plunger.

3. The apparatus of claim 1, wherein a moving direction of the first plunger is perpendicular to a rotation shaft of the rotation unit, and a moving direction of the second plunger is perpendicular to the moving direction of the first plunger.

4. The apparatus of claim 1, wherein one surface of the first plunger pressed by the intermediate unit has a hemispherical shape.

5. The apparatus of claim 1, further comprising a plurality of guide portions formed in the housing, and protruding toward a center of an inner space of the housing so as to guide movements of the first plunger.

6. The apparatus of claim 1, wherein a stopping recess is formed at the intermediate unit, and a stopping protrusion inserted into the stopping recess is formed at one end of the second plunger.

7. The apparatus of claim 6, wherein a protrusion is formed at the second plunger, and the stopping protrusion is inserted into the stopping recess when the protrusion comes in contact with the housing.

8. A cannon, comprising:

a cannon barrel configured to fire ammunition;

a breech block configured to open and close a cartridge chamber of the cannon barrel for loading of ammunition;

a cannon holder configured to mount the cannon barrel thereat, and inclined with respect to a ground surface such that the cannon barrel is toward a specific firing direction; and an apparatus for opening and closing a breech block, the apparatus comprising:

a cam follower connected to a breech block for opening and closing a cartridge chamber of a cannon barrel, and rotating so as to open and close the breech block;

a housing mounted to a bracket;

a first plunger mounted in the housing, and disposed to be moveable in one direction;

a rotation unit rotatably mounted to the bracket;

an intermediate unit coupled to the rotation unit, inserted into the housing, and configured to press the first plunger when the rotation unit rotates;

an open cam coupled to the rotation unit, and moveable by rotation of the rotation unit between a first state for guiding rotation of the cam follower and a second state which is out of the range of a moving path of the cam follower;

a first elastic member installed in the housing, and configured to support the first plunger such that a restoration force is applied to the rotation unit; and a second plunger moveably mounted in the housing, and configured to support the intermediate unit in the second state by movements of the second plunger.

9. The cannon of claim 8, further comprising a second elastic member mounted to the housing, and configured to apply an elastic force to the second plunger.

10. The cannon of claim 8, wherein a moving direction of the first plunger is perpendicular to a rotation shaft of the rotation unit, and a moving direction of the second plunger is perpendicular to the moving direction of the first plunger.

11. The cannon of claim 8, wherein one surface of the first plunger pressed by the intermediate unit has a hemispherical shape.

12. The cannon of claim 8, further comprising a plurality of guide portions formed in the housing, and protruding toward a center of an inner space of the housing so as to guide movements of the first plunger.

13. The cannon of claim 8, wherein a stopping recess is formed at the intermediate unit, and a stopping protrusion inserted into the stopping recess is formed at one end of the second plunger.

14. The cannon of claim 13, wherein a protrusion is formed at the second plunger, and the stopping protrusion is inserted into the stopping recess when the protrusion comes in contact with the housing.

* * * * *